US005098361A

United States Patent [19]

Danylieko

[11] Patent Number: 5,098,361

[45] Date of Patent: Mar. 24, 1992

[54] CENTER SUPPORTED WEIGHT LIFTING BARS

[76] Inventor: Richard A. Danylieko, 4850 Sunset Rd., St. Cloud, Fla. 34771

[21] Appl. No.: 600,692

[22] Filed: Oct. 22, 1990

[51] Int. Cl.[5] ..... A63B 21/06

[52] U.S. Cl. ..... 482/97; 482/106

[58] Field of Search ..... 272/117, 118, 123, 134, 272/143, DIG. 4

[56] References Cited

U.S. PATENT DOCUMENTS

| | | | |
|---|---|---|---|
| 2,722,419 | 11/1955 | Tarapczynski . | |
| 3,003,765 | 10/1961 | Dove | 272/117 |
| 4,205,838 | 6/1980 | McIntosh . | |
| 4,252,314 | 2/1981 | Ceppo . | |
| 4,256,301 | 3/1981 | Goyette . | |
| 4,344,619 | 8/1982 | Szabo | 272/117 |
| 4,368,884 | 1/1983 | Colvin . | |
| 4,407,495 | 10/1983 | Wilson | 272/117 |
| 4,455,020 | 6/1984 | Schnell | 272/123 |
| 4,471,956 | 9/1984 | Marlo . | |
| 4,561,651 | 12/1985 | Hole . | |
| 4,605,222 | 8/1986 | Shannon . | |
| 4,629,184 | 12/1986 | Selkee . | |
| 4,690,400 | 9/1987 | Metz . | |
| 4,720,096 | 1/1988 | Rogers | 272/117 |
| 4,863,158 | 9/1989 | Tassone . | |
| 4,875,676 | 10/1989 | Zimmer . | |
| 4,903,962 | 2/1990 | Pollack . | |
| 4,921,246 | 5/1990 | Hornbostel | 272/123 |

FOREIGN PATENT DOCUMENTS

| | | | |
|---|---|---|---|
| 151840 | 10/1920 | United Kingdom | 272/123 |

*Primary Examiner*—Robert Bahr
*Attorney, Agent, or Firm*—Julian C. Renfro

[57] ABSTRACT

A two-piece weightlifting bar offering safety to the weightlifter, this two-piece weightlifting bar comprising a pair of curved bars having first ends disposed in an adjacent, rotatable relationship. The curved bars have respective second ends remotely located with respect to the first ends, with such second ends being configured to receive weights of selected size. A common support member is provided for the first ends, with the common support member including an arrangement for anchoring the first ends against separation, but permitting ready rotation of the curved bars. Handgrips are located in the near vicinity of the second ends of the bars, so as to enable the user to grasp and then lift the second ends of the bars. The lifting of the second ends of the bars brings about the lifting of the weights as well as causing rotation of the first ends in the support member. The height of the common support member can be readily altered, so as to change the arc of movement of the handgrips, thus enabling the weightlifter to put emphasis on selected muscle groups of his torso.

14 Claims, 3 Drawing Sheets

FIG 1
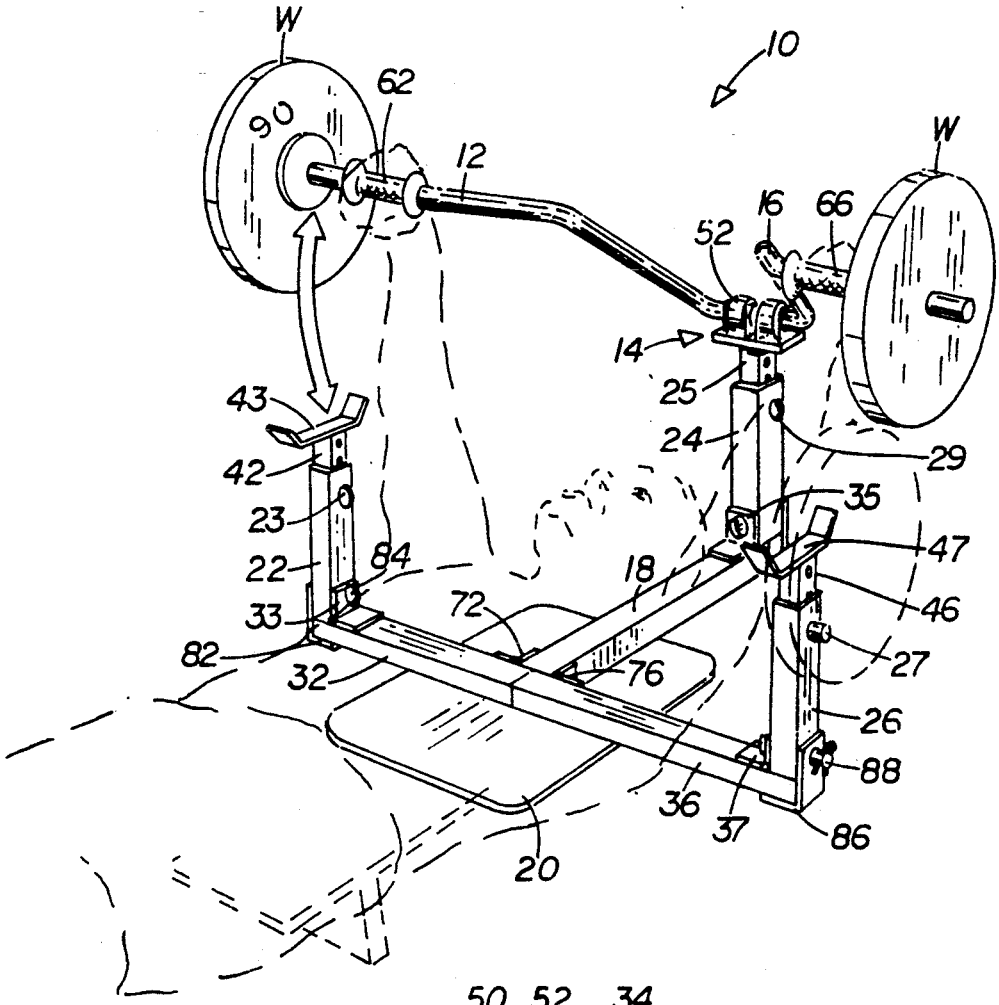
FIG 2a
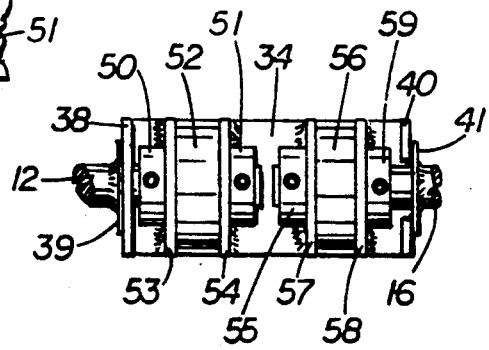
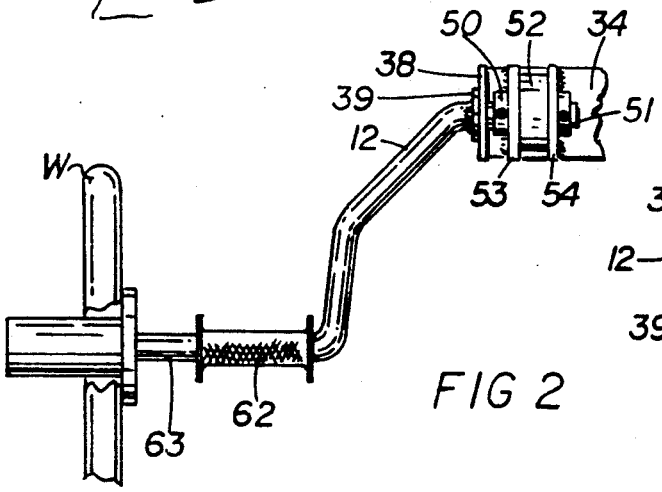
FIG 2

CENTER SUPPORTED WEIGHT LIFTING BARS

BACKGROUND OF THE INVENTION

Many weight lifting exercise machines have been developed and patented over the years. The goal of most of these machines is to provide safe and convenient exercise during which weights, which are either remotely located and operated by cables and pulleys or mounted locally as on a weight bar, are lifting against the force of gravity. These machines, with few exceptions comprise a captive weight, or a weight that is supported in the machine in a manner that the user need exert a force only in a generally upward direction to perform the required exercise. Balance and coordination of effort by various muscles involved in the lifting process are not necessarily used when using such apparatus. Many weightlifters and bodybuilders are returning to what is called "free-bar" exercises after having used such other equipment. "Free-bar" exercises are those wherein the control and balancing of the weight is the total responsibility of the user. They have found that the exercise machines available to them are suitable for exercising the large muscles of the body, but, because they do not require the user to control the weight in terms of balancing it, these machines fail to provide proper exercise for the finer muscles that are so important in balancing. One can readily imagine an athlete who has been trained exclusively on weight training machines having captive weights and who is therefore fully capable of lifting a weight, but is incapable of controlling the weight once it is lifted.

The weight lifting exercise known as the bench press requires a weightlifter to lie in a substantially supine position on a bench under a weight bar that carries a preselected amount of weight evenly distributed on the ends of the bar.

It should be understood that in most cases the bench is horizontal, although in some cases the bench or a part thereof may be inclined, usually with the user's head higher than his torso; in either case, I consider the user's position to be supine, by which reference I embrace the horizontal and the inclined orientations. The weight bar is then lifted off the rack (attached to the bench at nearly the full extension of the user's arms) and brought down to the user's chest. The exercise then comprises lifting the weight from the chest to the full extension of the arms and returning it to the chest, and then repeating this procedure for an appropriate number of times.

At the completion of a period of exercising, the user must again lift the weight bar to the full extension of his arms to return the weight bar to the rack. Obviously, when the user is fatigued, as is often the case when the user has forced himself to perform more repetitions than he felt was his capacity, which technique is commonly called "overloading," the return of the weight bar to the rack is difficult or even dangerous.

Although weightlifters and bodybuilders know that safety should be of primary concern and that a second person should be ready to help or to remove the weight bar when such help is needed, the pressures of time and the availability of equipment for exercising lead them to ignore this important safeguard. Even when the safeguard is observed, injury can occur if the second person, the "spotter," takes inappropriate or unexpected action in his efforts to provide help to the exerciser.

Recent developments in the art of bodybuilding teach that greater effectiveness is obtained by exercising in the so-called "eccentric contraction" mode. To adherents of the eccentric contraction method, lifting the weight bar against the pull of gravity is considered less effective in building or developing muscle tissue than is slowly lowering the weight from the initial full extension to the contracted position wherein, for the bench press, the weight bar is near the chest.

The adherents of the eccentric contraction mode would prefer to have aid from a source other than the muscle group being exercised to lift the weight; they then exercise the desired muscle group primarily during the slow lowering of the weight bar. When a spotter is used to accomplish this mode of exercise, the transfer of the weight bar from the user to the spotter and back again while it is always positioned above the user's reclining body, carries obvious hazards with respect to timing and coordination of the efforts of the two people to prevent the heavily-weighted bar from being dropped, causing serious injury to the user.

From the standpoint of time utilization, it would be desirable to have equipment that would make the bench press exercises described herein suitable to be performed by a solitary user without a spotter, even for the adherents of eccentric contraction or users of forced repetitions, while at the same time improving the safety of the exercise.

A significant contribution to the safety of the user of a free-bar bench press exercise was taught in U.S. Pat. No. 4,256,301, issued to R. G. Goyette. Goyette teaches the use of a weighted bar suspended from an overhead tower by means of a cable passing through a pulley, thence to foot member, bar, or element slidably mounted on a secondary frame assembly mounted on the foot end of the bench. Movement of the foot element towards the foot end of the bench will cause the cable to elevate the weighted bar. One should note that there lacks in Goyette a desirable one-to-one ratio between the motion of the foot element and the motion of the weighted bar. In addition, the presence of the secondary frame assembly and foot element severely restricts the movement of the exerciser in mounting, dismounting, and especially in opting to make use of the foot member after a period of exercising without engaging the foot element.

Presumably, the exerciser would be in a supine position with legs extended beneath the foot element (and not on the floor) during exercise not employing the foot element. Should the exerciser encounter difficulty in raising the weight from his chest, the foot element would be in a position on the secondary frame assembly nearest the head end of the bench, in which position the foot element presents itself as a barrier to the exerciser's raising of his legs to engage the foot element with his feet. Although an alternative exercise position would have the exerciser straddle that portion of the bench occupied by the secondary frame, that position would be exceptionally inconvenient.

Thus, although Goyette allows the exerciser to safely bench press a weight at or near the limit of his strength, he does not provide for forced repetitions in a standard, foot-planted exercise position with easy transition to a foot-aided lift when the exerciser is exhausted; neither does Goyette provide an adjustable safety stop, much less a self-positioning safety stop. The apparatus taught by Goyette is thus not seen as permitting the execution of the standard bench press.

U.S. Pat. No. 4,205,838 to McIntosh discloses safety stands for use in protecting persons from injury by the droppage of barbells during bench pressing. The McIntosh patent does not disclose that the width of the stands should be sufficient to prevent injury to at least the face, neck, and chest cavity of the lifter. Moreover, the individual stands are not rigidly attached to a frame as in the present invention which decreases their stability. With the safety stands of that patent where the lifter has a loss of control, it would be possible to have the barbell far enough out of position with respect to the upturned ends to tip the stands, thereby causing injury.

U.S. Pat. No. 4,471,956, issued to S. M. Marlo, teaches the use of a cable-tethered weight bar wherein the cable leads to a safety weight that, when released by a trip lever operated by the user's foot, counterbalances part of the weight of the weight bar to help the user lift the bar to return it to the rack. Thus, after several forced repetitions to the point of severe fatigue, the user merely trips the foot-operated trip lever for help to return the bar to the rack. An added feature to protect the user if the bar is accidentally dropped, is that a protuberance on the cable engages a pulley and stops excessive downward movement of the weight bar.

Although the Marlo patent has merit, there are some obvious shortcomings. The trip lever must be re-strung with the safety cable after each use. The main cable is slack during the exercise and can easily jam in the pulleys to the extent that the counterweight feature is completely disabled.

U.S. Pat. No. 4,252,314 issued to L. Ceppo, teaches a device for performing weight lifting exercises that includes connecting a slidably guided weight bar by means of overhead cables to stirrups engaged by the means of overhead cables to stirrups engaged by the feet before bench press exercises involving forced repetitions are begun. The user may therefore use his legs to assist the lifting of the weight bar during forced repetitions. Since the rest position of the weight bar is not on an elevated rack, but rather on stops that provide clearance above the user's chest, and since the stirrups are in a position to require a pulling force to be exerted downward by the feet in a manner wherein I observe that leverage is minimal, the reason for providing the cable and stirrups as an aid to bench pressing is unclear. Ceppo's apparatus would be inappropriate for use by a weightlifter in training as the proper standard bench press position and the good base for proper balance commensurate with the standard position is not enabled by the apparatus.

U.S. Pat. No. 4,561,651, issued to R. W. Hole, teaches a free-bar simulating bench press apparatus wherein the weight bar is tethered by cables to tension-maintaining weights that serve as safety stops that engage adjustably-positioned barriers to prevent the weight bar from falling upon the user. This patent, although it provides safety to the user of the apparatus, does not include any provision to help the user of the apparatus to return the weight bar to the rack after forced repetitions, nor does it offer the advantages to be had by using the eccentric contraction technique with an assisted lifting and unassisted lowering of the weight bar.

U.S. Pat. No. 4,605,222 issued to G. L. Shannon describes a weightlifting bar that may be considered a special purpose dumbbell designed for lifting relatively light loads with one or two hands. The bar described in the Shannon patent includes a straight short center section, a pair of short handles that extend radially at right angles from each end of the center section, and a pair of side sections extending at an acute angle with respect to the center section from the extended ends of each of the handles. The center of gravity of this weight-loaded bar is centered between the handles both laterally and longitudinally; that is, at about the middle of where the user ordinarily grasps the bar. Because of its configuration and the relative position of the center of gravity, this prior bar, when loaded with weights, can be used to perform a variety of exercises without undesirable torque loading on the user's wrists. If the center of gravity of the loaded bar is not centrally disposed between the handles at all times, greater or lesser torque would be experienced by the user as the movement of the user's wrists rotates the weight center outward and upward.

It was to overcome the shortcomings and disadvantages of these prior art arrangements that the present invention was made.

SUMMARY OF THE INVENTION

In accordance with this invention, a two-piece weightlifting bar offering safety to the weightlifter is provided. My two-piece weightlifting bar advantageously comprises a pair of curved bars having first ends disposed in an adjacent, rotatable relationship, and having respective second ends remotely located with respect to the first ends. The second ends are configured to receive weights of selected size, and common support means are provided for the first ends.

The common support means include means for anchoring the first ends against separation, but permitting ready rotation of the bars, and handgrip means are located in the near vicinity of the second ends of the bars, so as to enable the user to grasp and then lift the remote ends of the bars for a desired number of repetitions. The lifting of the remote ends of the bars involves arcuate movement of the remote ends, as well as rotation of the first ends of the bars in the support means.

Advantageously, no straight bar connects the handgrips, thus making it impossible for the weight carried at the remote ends of the curved bars to bring about injury to the chest, neck or head portions of the weightlifter should the weightlifter inadvertently release the handgrips.

I preferably construct the centrally disposed common support means to enable their effective height to be readily adjustable, with height adjustments serving to change the location of the arc through which the remote ends of the bars move, and thus enable the weightlifter to achieve a selectivity of effort. Thus, when the common support means is adjusted to a comparatively high elevation, a component of thrust away from the support means is developed as the remote ends of the bars are lifted.

On the other hand, when the common support means is adjusted to a comparatively low elevation, a component of thrust toward the support means is developed as the remote ends of the bars are lifted.

A primary object of this invention is thus to provide a two-piece weightlifting bar offering inherent safety during benchpresses and similar weightlifting exercises by having no straight bar interconnecting the handgrips of the bar.

Another object of this invention is to provide a pair of curved bars whose adjacent ends are fastened together in a hinged relationship upon a central support, thus making it impossible for the weightlifter grasping the opposite ends of the bars to be injured should he lose his grasp and drop the bars.

Still another object of this invention is to provide a weightlifting device utilizing a pair of curved bars whose adjacent ends are hingedly supported by a central member of adjustable height, the height adjustment of the central member making it possible for a weightlifter to achieve a selectivity of effort.

Yet another object of this invention is to provide a substantial improvement over the conventional straight bar used by weightlifters by providing a curved pair of bars whose inner ends are hingedly mounted upon a common central support, and whose outer ends can be grasped at locations somewhat inboard of the weights placed at the outer ends of the bars, with the weightlifter being able to raise and lower the outer ends of the bars in an arcuate manner for a suitable number of repetitions without any threat to his safety.

Yet still another object is to provide a two piece weightlifting bar usable for a variety of exercises.

These and other objects, features and advantages will be more apparent from a study of the appended drawings and written description.

BRIEF DESCRIPTION OF DRAWINGS

FIG. 1 is a perspective view revealing the manner in which a weightlifter would go about using my novel two-piece weightlifting bar, with this figure showing that inner ends of the curved bar halves are rotatably supported at a common central location;

FIG. 2 is a fragmentary view of one of the bar halves, revealing that the inner end of the curved bar is essentially parallel to the outer end, where the handgrip is located, and where the weight is placed;

Figure 3:
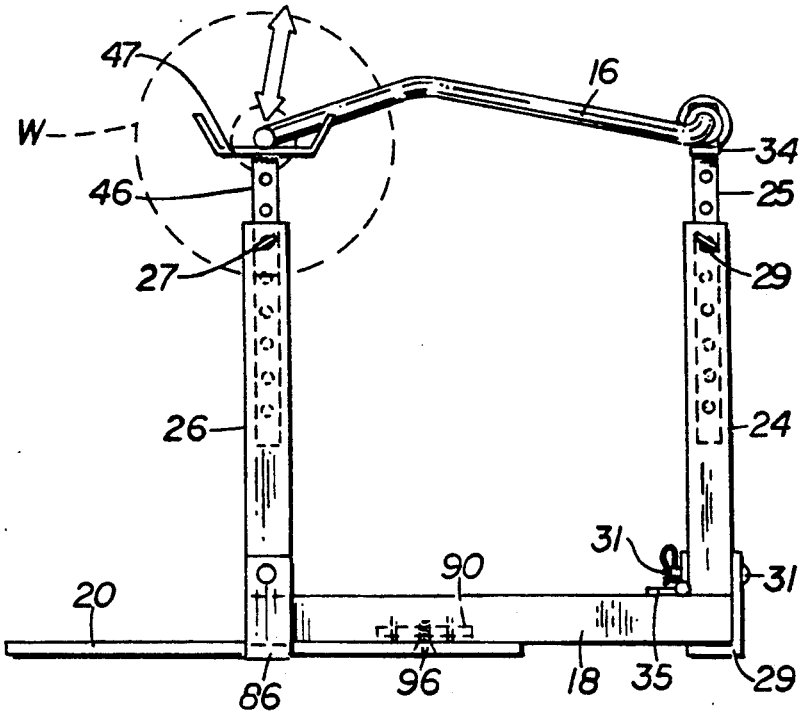
Figure 4:
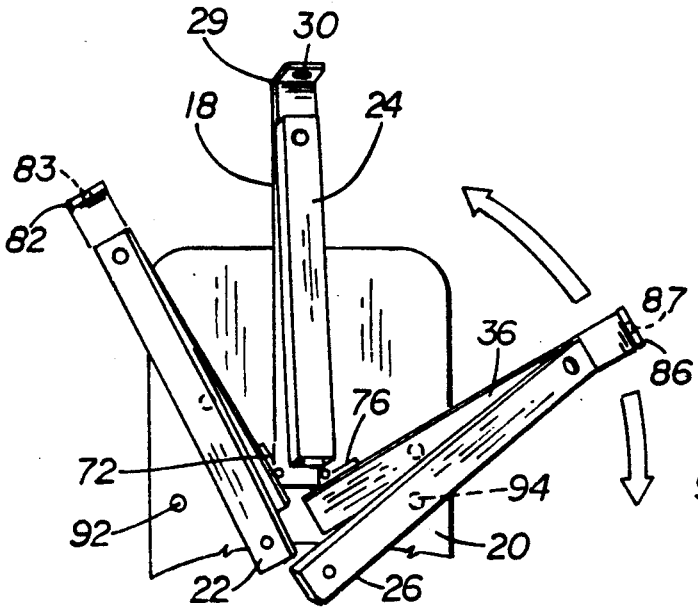
Figure 5:
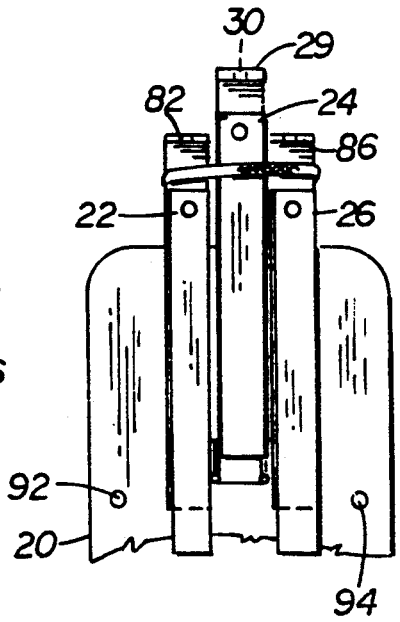
Figure 6:
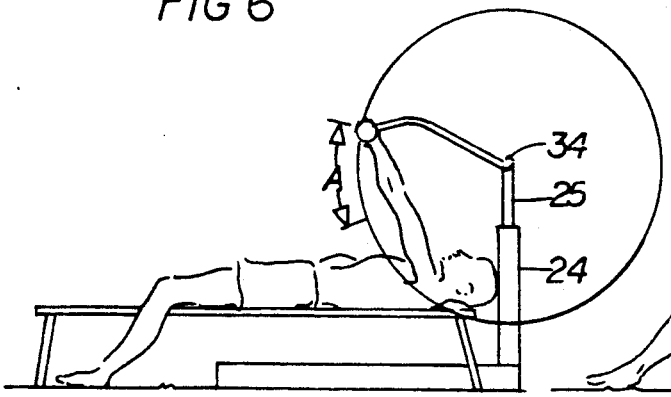
Figure 9:
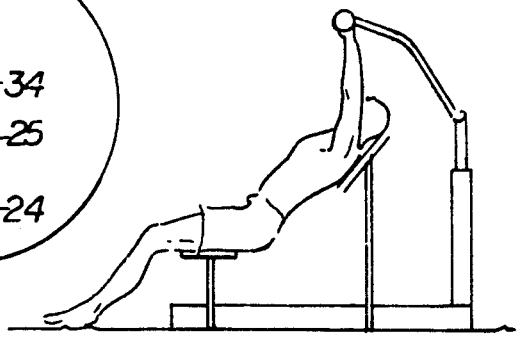
Figure 7:
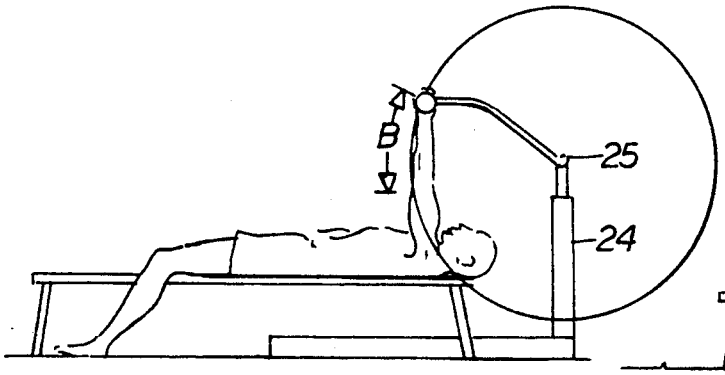
Figure 10:
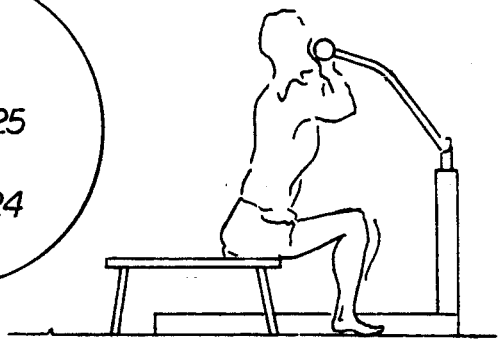
Figure 8:
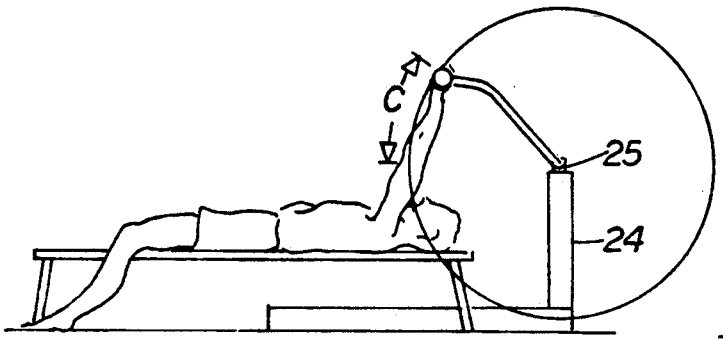
Figure 11:
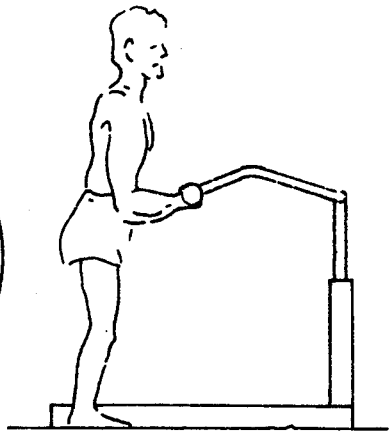

FIG. *2a* is a fragmentary view to a somewhat larger scale of the bearing arrangement that forms the support for the inner ends of the curved bars;

FIG. 3 is a side view of my novel, two-piece weightlifting device, with this figure revealing that the common support for the inner ends of the curved bars is constructed to be of adjustable height;

FIG. 4 is a view revealing how the lower structural members constituting my device can be folded for storage or shipment, by virtue of the provision of suitable hinges at juncture locations;

FIG. 5 is a view depicting the structural components in their fully folded condition;

FIG. 6 is a first of several simplified figures revealing the versatility of my invention, with FIG. 6 representing how my invention may be used in the performance of bench presses with the center support for the inner ends of the bars located in a comparatively high position, thus to bring about motion of the remote ends of the bars about a comparatively low arc;

FIG. 7 is a view similar to FIG. 6, but showing how benchpresses can be performed with the center support for the inner ends of the bars in a mid position, thus causing the remote ends of the bars to move about a mid-range arc;

FIG. 8 is a view similar to FIGS. 6 and 7, but showing how benchpresses can be performed with the center support for the inner ends of the bars in its lowest operative position, thus to cause the remote ends of the bars to move about a comparatively high arc;

FIG. 9 is a simplified view revealing how my device may be utilized by a weightlifter in the performance of inclined presses;

FIG. 10 is a simplified view revealing how my device may be utilized by a weightlifter in the performance of overhead presses; and FIG. 11 is a simplified view revealing how my device may be utilized by a weightlifter in the performance of standing curls.

DETAILED DESCRIPTION

With initial reference to FIG. 1, it will be seen that my novel, two-piece weightlifting bar 10 is revealed, this including a bar half 12 located on the left side of the device, and a bar half 16 located on the right side of the device. As will be noted from FIGS. 1 and 2, each bar half is curved, having compound bends so as to enable very effective use for several different types of exercises.

The inner end of each bar half is hingedly mounted upon center support 14, that forms a common support for what may be regard as the first ends of the curved bars.

The bars or bar halves 12 and 16 are configured in a like manner, with one bar half being regarded as substantially symmetrical with the other bar half, although the bar halves are not interchangeable. As will be described at greater length hereafter, the center support 14 for bar halves 12 and 16 is in turn supported from a vertically disposed mounting means 24, the bottom of which is hingedly attached to fixed horizontal member 18. It is to be understood that horizontal member 18 is rigidly yet removably secured to base plate 20, such as by the use of a flathead screw 96, which threadedly engages a nut plate 90 secured such as by pop rivets inside member 18, as shown in FIG. 3.

Hingedly attached to the member 18 are structural members 32 and 36, with steel tubing of square cross section preferably being used in the construction of these members. Because of the hinged relationship, the members 32 and 36 can be readily moved from the folded relationship illustrated in FIG. 5, into the deployed position illustrated in FIG. 1, in which they form a straight line perpendicular to the member 18.

On the outer ends of the members 32 and 36 are provided support means for the outer ends of the bars 12 and 16, which support means will be discussed at greater length hereinafter.

Although I am not to be limited to any particular arrangement, I prefer to also install a nut plate containing at least one threaded hole into the interior of both of members 32 and 36, so that each of these members can also be removably affixed to the plate 20 when the members 32 and 36 have been moved into their extended positions depicted in FIG. 1. Therefore, at such time as the members 32 and 36 are to be attached to the baseplate 20, flathead screws are inserted up through the countersunk holes 92 and 94 located in the baseplate 20, as illustrated in FIG. 4, so that the respective nut plates (not shown) can be engaged.

The screw holding the base plate 20 to the member 18 is not normally removed when my device is to be stored, but the screws used to hold the members 32 and 36 to the base plate may be removed at that time to permit folding of members 32 and 36. All of these screws are to be removed, however, when my device is to be shipped.

It will be observed that the bar halves 12 and 16 are shown together in their raised positions in FIG. 1, but it is to be understood that the bar halves ma be raised individually should such be desirable. This is borne out by the dashed line position of the bar 16 in FIG. 1, indicating that the weightlifter may elect to lift the bars differentially rather than together if he so wishes. For example, the weightlifter may wish to do standing curls using each arm individually.

It is important to note that support member 22 is positioned to support the bar half 12 when the bar half has been returned from the raised position to the rest position. Similarly, support member 26 is positioned such that it can serve to support the right bar half 16 when that bar half has been returned to its rest position.

It is to be understood that vertically disposed members 22, 24 and 26 are each preferably hollow, with left support member 22 containing in its interior a vertically slidable member 42, the exterior of latter member being configured to be closely received in the interior of member 22. Similarly, a vertically slidable member 25 is configured to be closely received in member 24, and a vertically slidable member 46 is configured to be closely received in the interior of right support 26.

As is obvious from FIG. 1, I prefer to construct vertically disposed members 22, 24 and 26 to be of square cross section, with the members slidable therein likewise being of square cross section, but I am obviously not to be limited to this.

It is important to note that I provide a spaced series of holes along the length of each of members 25, 42 and 46, into any one of which holes a respective pin may be slid in order to firmly establish the location heightwise for the center support 14, and to firmly establish the effective height for the supports for the left bar half 12 and for the right bar half 16. In FIG. 1 I utilize a pin 23 in conjunction with vertically disposed member 22, whereas in conjunction with vertically disposed member 26 I utilize a pin 27 in order that the members 42 and 46, respectively, can be locked in a heightwise sense in desired locations.

It is also to be noted at the upper end of vertically slidable member 42 that a generally U-shaped member 43 is utilized, whereas at the upper end of vertically slidable member 46 a generally U-shaped member 47 is located. The U-shaped members 43 and 47 serve the obvious purpose of assuring that the ends of the bar members 12 and 16 will be effectively supported upon the upper ends of members 42 and 46, irrespective of some lateral displacement.

As revealed in FIG. 2, the portion of left bar half 12 supported in its respective roller bearing 52 is essentially parallel to the portion of the bar half upon which handgrip 62 is located. The weight W is, quite obviously, placed outboard of the handgrip 62. The handgrip 62 is rotatable with respect to the left bar half 12, so that the weightlifter need not be confronted with a situation in which the bar half is turning in his grasp when he presses the bar half upwardly. Likewise, handgrip 66 is constructed to be rotatable upon right bar half 16. The handgrips 62 and 66 as well as the weights W are of conventional construction.

As revealed in FIG. 2, a space 63 exists between the handgrip 62 and the weight W, which is the location on the bar 12 that is contacted by the U-shaped member 43 atop the vertically adjustable member 42.

Although the entire right bar half 16 is not depicted in a separate figure it is to be understood to be essentially congruent with or symmetrical with bar half 12, and to contain the same features.

With further reference to FIG. 2, it is to be realized that the roller bearing 52, in the inner race of which the inner end of the bar 12 is secured, is tightly supported by a bearing support plate 34 that forms a part of the center support 14. The bearing 52 is of sturdy construction and forms a highly effective support for the inner end of the bar 12. It is to be noted that the center support 14 is in turn supported from the member 25 slidable in the vertically disposed member 24.

To form a particularly stable support for the inner ends of the bars 12 and 16, and minimize "play" in the free ends of these bars, I provide a rigid end member 38 on one end of the support plate 34, and a rigid end member 40 on the other end of the support plate 34

With regard to the end member 38, I provide a hole therein that is only slightly larger than the diameter of the bar 12, through which hole the inner end of the bar 12 is inserted before the end of the bar is inserted into the inner race of the bearing 52. I may weld a flat washer 39 onto the bar 12 in a position residing against the end member 38.

To the outer sides of the outer race of bearing 52 are secured plates 53 and 54, which plates contain central holes through which the inner end of the bar 12 extends, and the bottoms of which plates are welded to the lower inside surface of the bearing support plate 34. It is by virtue of the plates 53 and 54 that the outer race of bearing 52 is firmly anchored to the support plate 34.

As made clear in FIG. 2 as well as in FIG. 2*a*, I use a pair of locking collars 50 and 51, which are secured at selected spaced locations to the inner end of the bar 12 by the use of lock screws. The locking collars serve the function of preventing the bar 12 from being displaced from the desired position. The bearing 52 and the locking collars thus may be regarded as anchoring the inner end of bar 12 against displacement from the desired relationship t the inner end of bar 16.

After the end of the bar 12 has been inserted through the central hole in the end member 38, but before the bar end has been inserted through the central holes in the plates 53 and 54 and the bearing, it is obvious that I must first insert collar 50 onto the bar 12. Then, after the inner end of the bar 12 is in place inside the inner race of the bearing 52, I insert the collar 51 on the innermost end of the bar, and tighten the set screws in both collar 50 and collar 51 in order to lock the bar 12 to the plates 53 and 54, and thus hold the inner end of bar 12 in the desired location. Because of this arrangement, the inner end of the bar 12 is tightly yet rotatively anchored.

With reference to FIG. 2*a*, it is to be noted that similarly located on the bearing support plate 34 is a roller bearing 56, in the inner race of which the inner end of the bar 16 is secured. Paralleling the construction utilized for supporting the inner end of bar 12, I secure plates 57 and 58 to the outer race of bearing 56, with the lower edges of these plates being secured, such as by welding, to the interior bottom surface of the plate 34. I previously mentioned that I also utilize an end member 40 on the end of the bearing support plate 34 nearest the bar 16, which end member contains a hole of a diameter only slightly larger than the diameter of the bar 16, thus giving added stability to the inner end of the bar 16. The washer 41 welded to the bar 16 is to be brought into close relationship to the end member 40.

After the end of the bar 16 has been inserted through the central hole in the end member 40, but before it is inserted through the central holes in the plates 57 and 58, I insert the collar 59 onto the bar 16. Then, after the inner end of the bar 16 is in place inside the inner race of the bearing 56 and has been passed through the plates, I insert the collar 55 onto the innermost end of the bar, and tighten the set screws in both collar 55 and collar 59 in order to hold the inner end of bar 16 in the desired rotatably mounted relationship.

As should now be clear, the arrangement including the bearing 56 is of sturdy construction and forms a highly effective support for the inner end of the bar 16, preventing the inner end of bar 16 from undesirably moving away from its closely spaced relationship to the inner end of bar 12.

One of the obviously important features of my invention is the fact that should the weightlifter become extremely tired during a bench press, it is impossible for him to be injured should his grasp of the handgrip 62 or 66 slip, or should the weights on the ends of the bars 12 and 16 suddenly become too heavy for him to hold aloft. In other words, there is no straight bar extending between handgrips 62 and 66 as might serve to injure or crush the weightlifter's neck or chest should he suddenly have the misfortune of unexpectedly permitting the weighted bars 12 and 16 to suddenly drop.

As earlier made clear, the support 22 I utilize on the left side of my device, and the support 26 I utilize on the right side of my device are positioned so as to be able to support, on occasion, the outer ends of the respective bar halves 12 and 16, so that the weights W will not come into contact with the supporting surface.

In FIG. 3 I reveal more of the constructional details of my device, including the slidable member 46 that is located in the interior of vertically disposed member 26. Shown in FIG. 3 are the numerous spaced holes in vertically slidable member 46 that may be selectively engaged by the pin 27. The pin 27 is operatively associated with the upper end of the vertically disposed support member 26 located on the right side of my device.

Also shown in FIG. 3 is the vertically slidable member 25 that is located in the vertically disposed member 24, with the numerous spaced holes in slidable member 25 making it readily possible for the weightlifter to cause the bearing support plate 34 serving as the common support means for the inner ends of the bars to be established in a desirable heightwise location with respect to the base plate 20. By insertion of the pin 29 in the selected hole located in the slidable support member 25, the weightlifter can readily establish the most appropriate height for the supported location about which the bars 12 and 16 can rotate. The pin 29 is operatively associated with vertically disposed center member 24. The locations available in a heightwise sense for the common support means 34 will hereinafter be discussed at further length.

As made clear in FIG. 1, and in FIGS. 3 through 5, hinged joints are utilized to a substantial extent in the construction of my device, with a hinged joint 37 being established where vertically disposed member 26 intersects the horizontal member 36. The hinge 37 readily permits the member 26 and the members carried therein to be folded over, on occasion, to the horizontal position, so as to lie alongside the member 36.

In a like manner, a hinged joint 33 is established where vertically disposed member 22 intersects horizontal member 32, with hinge 33 readily permitting the member 22 and the components to be carried therein to be folded over so as to lie adjacent the member 32, when the device is not in use.

From FIG. 3 it can be seen that I use a hinge 35 as the interconnection between the fixed horizontal member 18, and the vertically disposed central mounting means 24. To prevent the vertically disposed common mounting means from undesirably moving away from the relationship depicted in FIG. 3, I utilize a rigid corner support 29, with the lower leg of this corner support being tightly affixed to the underside of member 18, such as by bolting or welding. This lower leg of support 29 is approximately the same thickness as the thickness of the plate 20.

A hole 30 is provided in the vertical leg of corner support 29, with the hole 30 being in alignment with a hole provided near the lower end of member 24. A pin 31 is inserted when these holes have been brought into alignment, which firmly secures the member 24 in the vertical position. A pin clip, cotter key or the like may be utilized on the end of the pin 31 remote from the head of this pin. As is obvious, the hinge 35 permits the vertically disposed member 24 to be folded into close contact with the member 18 at such time as the pin has been removed, and my device 10 is to placed in a compacted condition for shipment or storage.

Also visible in FIG. 3 is the screw 96 previously described as inserted from below to tightly hold the member 18 to the upper surface of plate 20.

To simplify the compacting of my device for the purpose of storage or shipping, I utilize still further hinges, with a hinge 72 being located where member 32 intersects member 18, with this hinge 72 being visible in FIGS. 1 and 4. In a similar manner, hinge 76 is located where member 36 intersects member 18, with hinge 76 likewise being visible in FIGS. 1 and 4. As is obvious, the hinges 72 and 76 permit the members 32 and 36 to be folded in a horizontal plane for storage purposes at such time as the respective screws have been removed from plate 20. The folded positions of members 32 and 36 are clearly revealed in FIG. 5.

As shown in FIG. 5, an encircling band or tether may be utilized around the outermost ends of the members 22, 32 and 26, 36, to cause them to reside closely against the members 18, 24.

Quite obviously it would be undesirable for hinge movement to suddenly take place, as would permit the members 22, 24 and 26 to move away from their respective vertical positions. To this end, I utilize a corner support in the form of a rigid L-shaped member 82 on the bottom outer end of member 32, and a corner support in the form of a rigid L-shaped member 86 on the bottom outer end of member 36, with these details being made clear in FIG. 1. An additional effect of this construction is that by the lower legs of these L-shaped members being located under the ends of members 32 and 36, any tipping of the device is prevented, as might have occurred if a space were permitted to exist between the outer ends of 32 and 36, and the supporting surface. To gain this advantage, the lower leg of each of members 82 and 86 are approximately the same thickness as the plate 20.

As shown in FIG. 4, a hole 83 is provided in the upper leg of corner support 82, and a hole 87 is provided in the upper leg of corner support 86. Aligned with hole 83 is a hole near the bottom of member 22, and aligned with hole 87 is a hole near the bottom of member 26. The basis for this is to be observed in FIG. 1, where pin 84 is to be seen as having been inserted through the aligned holes in members 82 and 22, and a pin 88 is to be seen as having been inserted through the aligned holes in members 26 and 86. These pins quite obviously serve the purpose of holding the members 22 and 26 in their vertical positions, so that they will not unexpectedly move toward their folded positions. If desired, pin clips may be used on the ends of the pins 84 and 88.

Turning to FIG. 6, I there reveal in a simplified manner, the relationship of the weightlifter to my novel apparatus at the time he is performing benchpresses. As previously made clear, the fact that my novel curved bars are not secured directly together make it possible for the weightlifter to raise his arms alternately rather than together if he so desires.

In FIG. 6 it is to be noted that the extensible central member 25 has been moved to a comparatively high location, such that the ends of the curved bars 12 and 16 nearest the weightlifter are lower than the ends of these bars that are supported from the common support plate 34. As a result of this arrangement, the weightlifter is moving the hand grip portions of these bars about arc A, a comparatively low arc. This particular motion serves to help build the lower chest of the weightlifter.

In FIG. 7 it is to be noted that the extensible member 25 has been moved so as to cause the common support member to relocate to a mid location. This causes the weightlifter to be moving the handgrip portions of the bars 12 and 16 about midrange arc B, with this motion to help build the chest muscles of the weightlifter.

In FIG. 8 it is to be noted that the extensible member 25 has been moved so as to cause the common support member to assume its lowest location. This cause the weightlifter to be moving the handgrip portions of the bars 12 and 16 about the high arc C identified in FIG. 8, with this motion helping to build the upper chest and shoulders of the weightlifter.

FIG. 9 reveals in a simplified manner that the weightlifter need not be lying supine in a horizontal position, for from FIG. 9 it is readily apparent that he can be lying with his back resting on an inclined surface.

FIG. 10 reveals in a simplified manner that my invention can be utilized by a weightlifter that is concerned with performing overhead presses. In this figure the weightlifter is depicted in a seated position, but it is to be understood that by utilizing a center support member in a position of considerable height, the weightlifter could be in a standing position.

FIG. 11 reveals in a simplified manner that the weightlifter can utilize my novel apparatus for the performance of standing curls. As should be obvious by now, there is no requirement that the weightlifter lift his arms simultaneously, for many weightlifters prefer to do standing curls alternately, with one arm being raised as the other is being lowered. Because the bar halves are not directly interconnected, there is no requirement for the weightlifter to raise his arms simultaneously.

As by now should be obvious, my novel two-piece weight lifting bar offers a considerable degree of safety to the weightlifter, for inasmuch as there is no straight bar interconnecting the handgrips, there is no center portion of the bar to injure the weightlifter's neck or chest should he suddenly drop one or both ends of the bar.

As should also be apparent, the common support member for the inner ends of the bars can readily be adjusted heightwise, giving the weightlifter the option of selecting the muscle groups upon which he wishes to place emphasis at a given moment.

I claim:

1. A weightlifting apparatus having a two-piece weightlifting bar offering safety to the weightlifter, said two-piece weightlifting bar comprising a pair of curved bars having first ends disposed in an adjacent, independently rotatable relationship, said apparatus providing a fixed common support means for said first ends, said common support means including means for anchoring said first ends against separation, but configured to permit entirely independent rotation of said bars, said bars having respective second ends remotely located with respect to said first ends, said second ends being configured to receive weights of selected size, and handgrip means located in the near vicinity of said second ends of said bars, so as to enable the user to grasp and then lift said second ends of said bars, the lifting of said second ends of said bars bringing about the lifting of the weights as well as causing rotation of said first ends in said support means.

2. The two-piece weightlifting bar as recited in claim 1 in which the height of said common support means can be readily adjusted so as to alter the arc about which said handgrip means are rotated.

3. The two-piece weightlifting bar as recited in claim 1 in which the height of said common support means can be readily adjusted, so as to alter the arc about which said handgrip means are rotated, said common support means, when placed at a comparatively high location, bringing about a component of thrust away from said support means as said handgrip means are initially lifted, whereas when said common support means is placed at a comparatively low location, a component of thrust toward said support means is brought about as said handgrip means are initially lifted.

4. The two-piece weightlifting bar as recited in claim 1 in which respective support means are provided at the location of said second ends, to prevent said second ends from striking the supporting surface upon the weightlifter releasing his grasp of said handgrip means.

5. The two-piece weightlifting bar as recited in claim 4 in which said respective support means are of adjustable height.

6. A weightlifting apparatus having a two-piece weightlifting bar offering safety to the weightlifter, said two-piece weightlifting bar comprising a pair of curved bars having respective first ends disposed in an adjacent, rotatable relationship, said curved bars having respective second ends remotely located with respect to said first ends, said second ends being substantially parallel to said first ends and being configured to receive weights of selected size, said apparatus comprising a fixed common support means for said first ends, said common support means being of adjustable height and including means for anchoring said first ends against separation, but permitting entirely independent rotation of said bars, rotatable handgrip means located in the near vicinity of said second ends of said bars, so as to enable the user to grasp and then lift said second ends of said bars, the lifting of said second ends of said bars causing rotation of said first ends in said support means.

7. The two-piece weightlifting bar as recited in claim 6 in which the adjustment of the height of said common support means alters the arc about which said handgrip means are rotated, said common support means, when placed at a comparatively high elevation, bringing about a component of thrust away from said support means as said handgrip means are initially lifted, whereas when said common support means is placed at a comparatively low location, a component of thrust toward said support means is brought about as said handgrip means are initially lifted.

8. The two-piece weightlifting bar as recited in claim 6 in which respective support means are provided at the location of said second ends, to prevent said second ends from striking the supporting surface upon the weightlifter releasing his grasp of said handgrip means.

9. The two-piece weightlifting bar as recited in claim 8 in which said respective support means are of adjustable height.

10. A weightlifting apparatus having a two-piece weightlifting bar offering safety to the weightlifter, said two-piece weightlifting bar comprising a pair of curved bars having first and second ends, said apparatus also including a mounting base, said first ends of said bars being disposed in an adjacent, independently rotatable relationship and supported by common support means, said common support means being in turn supported by said mounting base, said second ends of said bars being remotely located with respect to said first ends and being configured to receive weights of selected size, said common support means, by virtue of its fixed relationship to said mounting base, forming a stable, fixed support for said first ends and including means for anchoring said first ends against separation, said common support means being configured to permit independent rotation of said bars, such that one of said bars can be moved by the weightlifter separately from the other, and handgrip means located in the near vicinity of said second ends of said bars, so as to enable the user to grasp and then lift said second ends of said bars, the lifting of said second end of one of said bars bringing about the lifting of the respective weights as well as causing rotation of said first end of only such one bar in said common support means.

11. The two-piece weightlifting bar as recited in claim 10 in which the height of said common support means can be readily adjusted, so as to alter the arc about which said handgrip means are rotated.

12. The two-piece weightlifting bar as recited in claim 10 in which the height of said common support means can be readily adjusted, so as to alter the arc about which said handgrip means are rotated, said common support means, when placed at a comparatively high location, bringing about a component of thrust away from said support means as said handgrip means are initially lifted, whereas when said common support means is placed at a comparatively low location, a component of thrust toward said support means is brought about as said handgrip means are initially lifted.

13. The two-piece weightlifting bar as recited in claim 10 in which respective support means are provided at the location of said second ends, to prevent said second ends from striking the supporting surface upon the weightlifter releasing his grasp of said handgrip means.

14. The two-piece weightlifting bar as recited in claim 13 in which said respective support means are of adjustable height.

* * * * *